US007859384B2

(12) United States Patent
Titus

(10) Patent No.: US 7,859,384 B2
(45) Date of Patent: Dec. 28, 2010

(54) DEVICES, SYSTEMS, AND METHODS FOR MANAGING A CIRCUIT BREAKER

(75) Inventor: Solomon R. Titus, Cumming, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 253 days.

(21) Appl. No.: 12/204,113

(22) Filed: Sep. 4, 2008

(65) Prior Publication Data

US 2009/0188893 A1 Jul. 30, 2009

Related U.S. Application Data

(60) Provisional application No. 61/024,368, filed on Jan. 29, 2008.

(51) Int. Cl.
*H01H 37/02* (2006.01)
*H01H 37/04* (2006.01)

(52) U.S. Cl. ..... 337/97; 337/110; 337/112

(58) Field of Classification Search ..... 337/97, 337/110, 278, 112; 218/149
See application file for complete search history.

(56) References Cited

U.S. PATENT DOCUMENTS 2,102,545 A * 12/1937 Rowe ..... 337/110
3,997,746 A 12/1976 Harper
4,470,027 A * 9/1984 Link et al. ..... 335/16
4,660,009 A * 4/1987 Wafer et al. ..... 335/6
4,862,131 A * 8/1989 Oster et al. ..... 337/48
4,982,174 A 1/1991 Fasano
5,206,614 A * 4/1993 Carothers ..... 335/16
5,260,533 A 11/1993 Livesey
5,341,191 A 8/1994 Crookston
5,877,691 A * 3/1999 Suptitz et al. ..... 340/638
6,838,962 B2 1/2005 Leone
2005/0057333 A1 * 3/2005 Subramanian et al. ..... 335/202

FOREIGN PATENT DOCUMENTS

WO WO2004/082091 9/2004

* cited by examiner

*Primary Examiner*—Anatoly Vortman
(74) *Attorney, Agent, or Firm*—Jose R. de la Rosa

(57) ABSTRACT

Certain exemplary embodiments can provide a system, which can comprise a wafer that defines an opening. The wafer can be adapted to be operatively installed between a mechanical portion of a circuit breaker and an electronic portion of the circuit breaker. When installed, the wafer can be adapted to receive a protrusion of the mechanical portion of the circuit breaker.

18 Claims, 7 Drawing Sheets

DEVICES, SYSTEMS, AND METHODS FOR MANAGING A CIRCUIT BREAKER

CROSS-REFERENCES TO RELATED APPLICATIONS

This application claims priority to, and incorporates by reference herein in its entirety, U.S. Provisional Patent Application Ser. No. 61/024,368, filed 29 Jan. 2008.

BACKGROUND

U.S. Pat. No. 6,838,962 (Leone), which is incorporated by reference herein in its entirety, allegedly discloses, "[t]he present invention provides a wire lug arc vent barrier for protecting a wire lug in a molded case circuit breaker, with the circuit breaker having a housing with a terminal for a load connection and a terminal for a line connection. The wire lug/arc vent barrier comprises a body having a first end including a tang, a second end including an elongated finger and a middle portion between the first end and the second end defining a concave space, with an opening at each of the middle portion, wherein the body is mounted in the housing." See Abstract.

World Intellectual Property Organization Publication No. WO 2004/082091 (Leone), which is incorporated by reference herein in its entirety, allegedly discloses, "[t]he electronic circuit breaker comprises an input (A, B) for connection to a power-supply network and an output (C, D) for connection to a load (Z). Set between the input and the output are a switch (7), a relay (8) and a limitation block (9), which controls the switch (7) to cause at least partial inhibition thereof in the event of overcurrent. Moreover provided is a microprocessor (13), which is connected to the limitation block (9) to inhibit power supply to the load (Z)." See Abstract.

U.S. Pat. No. 3,997,746 (Harper), which is incorporated by reference herein in its entirety, allegedly discloses, "[d]isclosed is a molded case type magnetic circuit breaker having improved performance and an increased current rating. A corrosion and temperature resistant stainless steel wire screen having specific wire and mesh opening sizes overlies a novel exhaust gas baffle arrangement to cool and disperse arc chamber gases venting from the breaker. Flashover during high current switching, due to conduction through the exhaust gas plasma, is eliminated. Also disclosed is a novel arc chamber construction for the circuit breaker and a marine baffle for adapting the breaker to use in potentially explosive atmospheres." See Abstract.

SUMMARY

Certain exemplary embodiments can provide a system, which can comprise a wafer that defines an opening. The wafer can be adapted to be operatively installed between a mechanical portion of a circuit breaker and an electronic portion of the circuit breaker. When installed, the wafer can be adapted to receive a protrusion of the mechanical portion of the circuit breaker.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
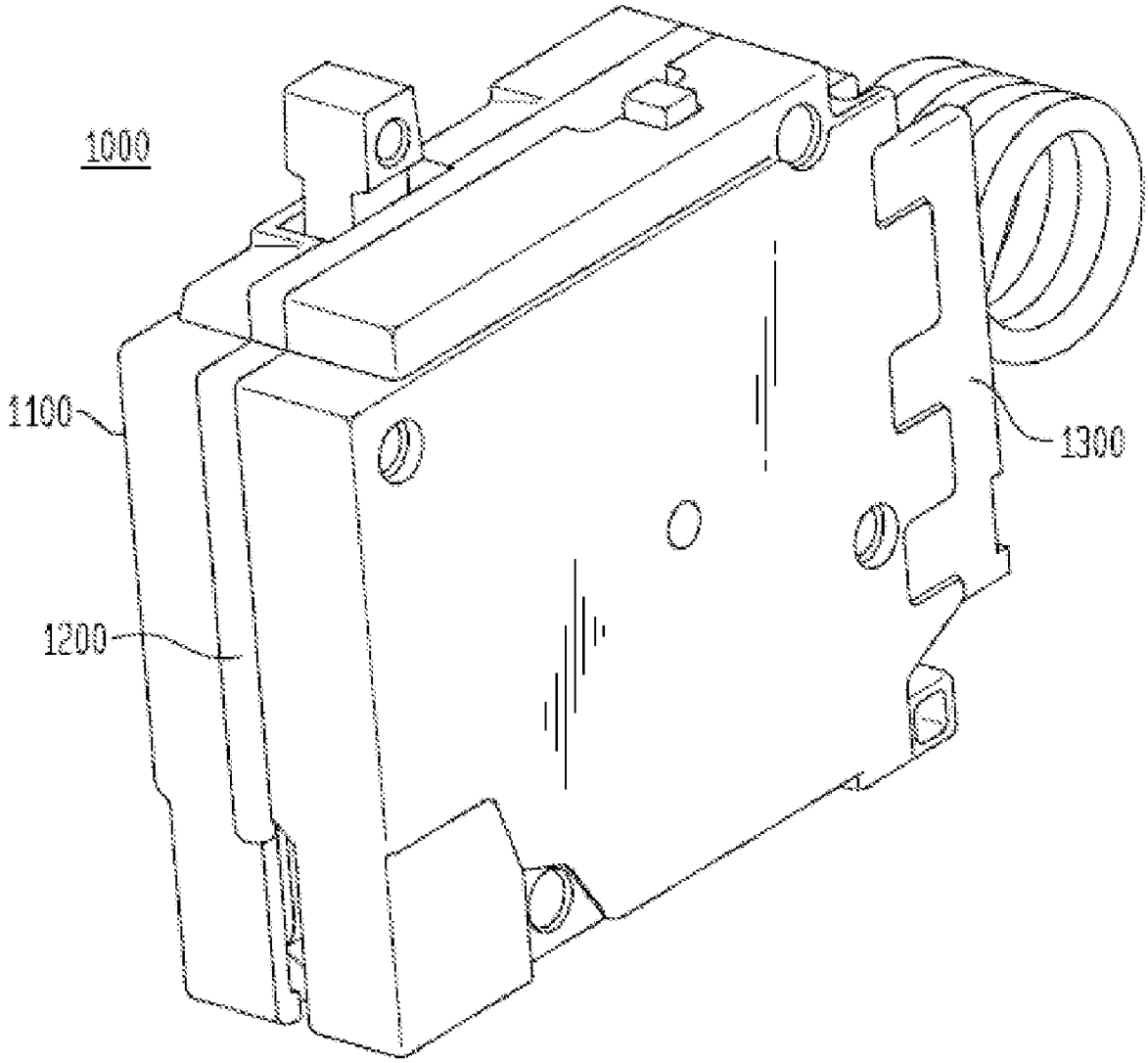
FIG. 1 illustrates a perspective view of an exemplary embodiment of a circuit breaker system, 1000 including features of the present invention therein.

Certain exemplary embodiments can provide a system, which can comprise a wafer that defines an opening. The wafer can be adapted to be operatively installed between a mechanical portion of a circuit breaker and an electronic portion of the circuit breaker. When installed, the wafer can be adapted to receive a protrusion of the mechanical portion of the circuit breaker.

Certain exemplary embodiments can resist a migration of debris and/or hot gases into an electronic compartment of an arc fault circuit interrupter (AFCI) residential circuit breaker during high interruptions. Certain exemplary embodiments can protect electronic components located on a printed circuit board (PCB).

Certain exemplary embodiments can provide a wafer in a mechanical pole that can protect internal components from debris and/or hot gases that could disable or damage electronic components in an adjacent electronic compartment.

Certain exemplary embodiments can reduce and or resist, during a short circuit event, a passage of hot gases or debris from a mechanical pole in to an electronic compartment by an opening surrounding an armature tab. Certain exemplary embodiments can resist a passage of gases and/or debris around an armature tab to an electronic compartment. Certain exemplary embodiments can reduce a possibility of damaging electrical components during a short circuit event.

Certain exemplary embodiments can have a relatively large opening in a cover to allow for the armature tab to pass and translate within the opening. The armature can be physically located in a mechanical pole and/or can incorporate a tab that is used to interface with components in an electronic compartment. Because of clearances between the armature tab and cover opening hot gases and/or debris can enter the electronic compartment. Hot gases and/or debris can contact a circuit board and/or expose components to high temperatures and/or debris that could potentially damage circuitry.

In embodiments including a cover with an opening, electrical components can be exposed to hot gases and debris from the mechanical compartment, during a short circuit event, which might disable electronic functions and/or cause a failure in an electronic circuit. Although a PCB can be coated, hot gases or debris can damage the PCB and/or related electrical components. In certain exemplary embodiments, special care can be used in production to coat the PCB.

Certain exemplary embodiments can resist a migration of hot gases and/or debris into the electronic compartment thus reducing a probability of failure of electronic circuitry from the hot gases and/or debris.

Certain exemplary embodiments can utilize one and/or two pole residential circuit breakers that include an armature design that enters the electronic compartment. Certain exemplary circuit breakers can comprise an AFCI, ground fault circuit interrupter (GFCI), thermal/magnetic protection, and/or electronic components used to trip a circuit. Certain exemplary embodiments can provide a wafer in the mechanical pole that is assembled on to the armature tab and/or can be at least partially housed by a recessed area in the cover. During a short circuit event pressure can build up in the mechanical pole. The pressure can result from plasma arcing taking place from the breaker interrupting the circuit. Because the wafer can be loose on the armature tab, the internal pressure in the mechanical compartment can force the wafer against the cover wall thus reducing the opening between the mechanical and electronic compartments. Certain exemplary embodiments can reduce a possibility of hot gases and/or debris entering the electronic compartment and reduce a probability of damage to electronic components on the PCB.

FIG. 1 is a perspective view of an exemplary embodiment of a circuit breaker system 1000, which can comprise a thermoelectric portion 1100 a mating portion 1200, and a data processing portion 1300. Thermoelectric portion 1100 can be adapted to house electromechanical components such as electrical contacts, an armature, and/or a bimetal, etc. Mating portion 1200 can be adapted to provide an interface that allows thermoelectric portion 1100 to be operatively coupled to data processing portion 1300. In certain exemplary embodiments, mating portion 1200 can be integral to either of thermoelectric portion 1100 or data processing portion 1300. In certain exemplary embodiments, mating portion 1200 can define a recess that can be adapted to at least partially house a wafer. The wafer can be adapted to resist migration of a gases and/or debris between thermoelectric portion 1100 and data processing portion 1300. Data processing portion 1300 can be adapted to house a microprocessor and circuitry. The microprocessor and circuitry of data processing portion 1300 can be adapted to cause circuit breaker system 1000 to trip responsive to a detected arc fault condition and/or a detected ground fault condition.

Figure 2:
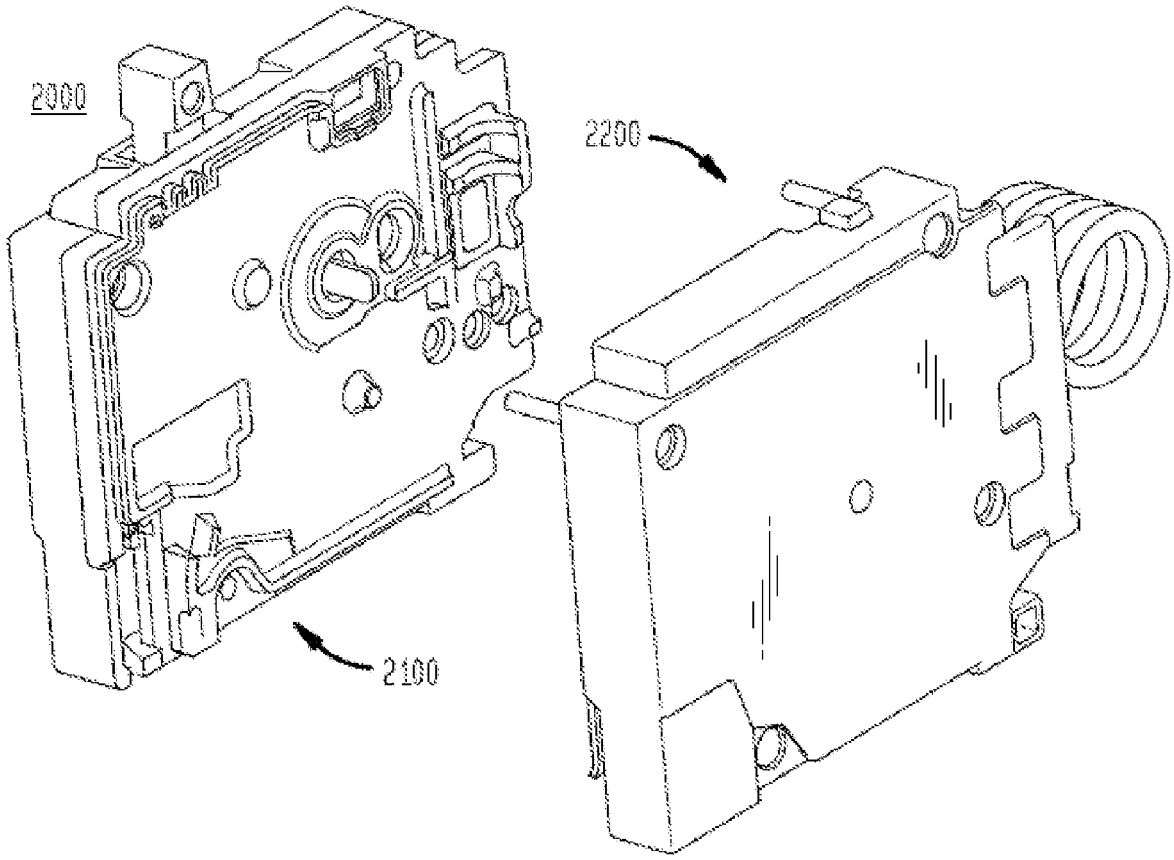
FIG. 2 illustrates an exploded perspective view of an exemplary embodiment of a circuit breaker system, 2000 including a mechanical portion and an electronic portion.

FIG. 2 is a perspective view of an exemplary embodiment of a circuit breaker system, 2000, which can comprise a mechanical portion 2100 and an electronic portion 2200. Mechanical portion 2100 can be adapted to house electromechanical components such as electrical contacts, an armature, and/or a bimetal, etc. Electronic portion 2200 can be adapted to house a microprocessor and circuitry. The microprocessor and circuitry of electronic portion 2200 can be adapted to cause circuit breaker system 2000 to trip responsive to a detected arc fault condition and/or a detected ground fault condition.

Figure 3:
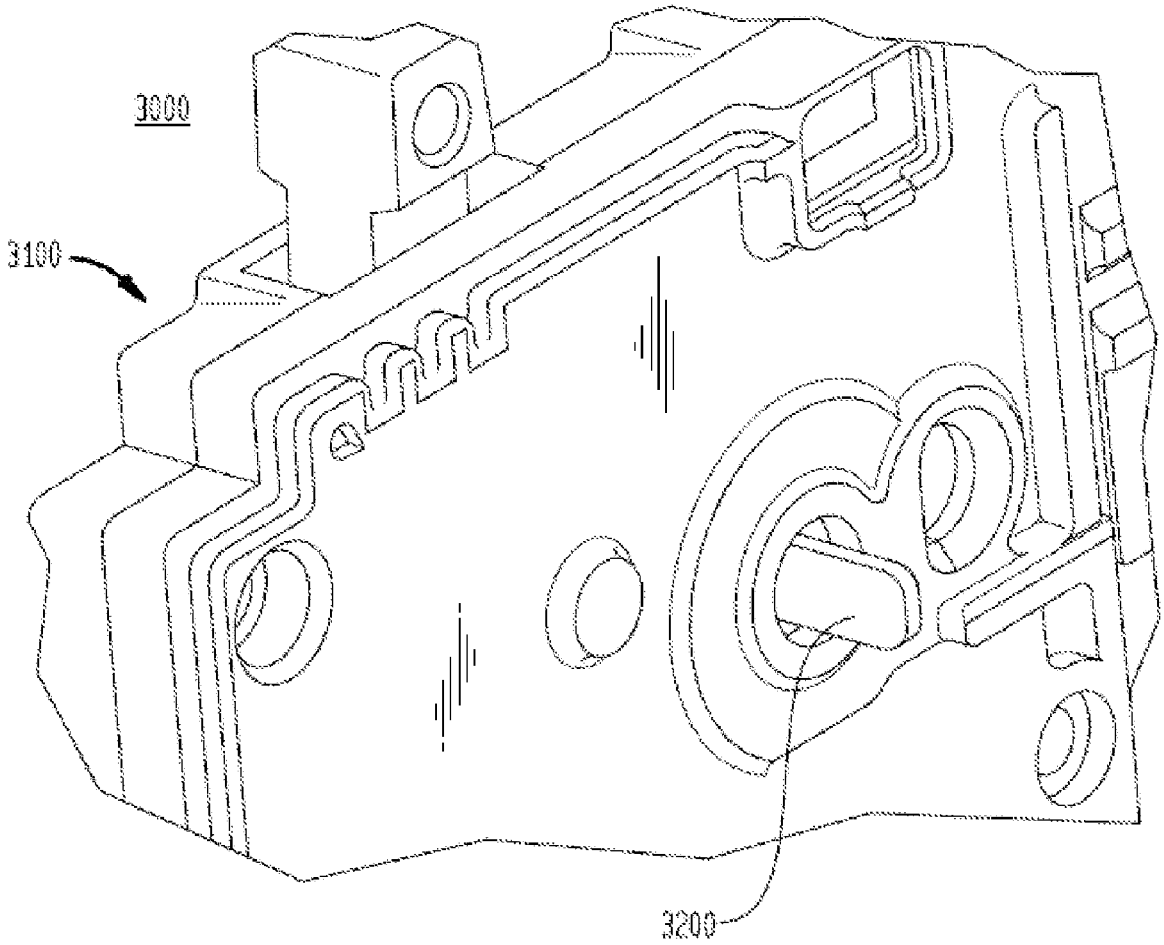
FIG. 3 illustrates a partial perspective view of a mechanical portion of an exemplary embodiment of a circuit breaker system, 3000 having an armature tab.

FIG. 3 is a perspective view of an exemplary embodiment of a circuit breaker system, 300, which can comprise a mechanical portion 3100. An armature tab 3200 can be adapted to protrude from mechanical portion 3100. Armature tab 3200 can be adapted to engage a corresponding defined opening of an electronic portion of circuit breaker system 3000. Electronic portion can be adapted to cause a rotation of armature tab 3200 responsive to a determination that an arc fault and/or a ground fault is detected via components of the electronic portion. Rotation of armature tab 3200 can cause a tripping of a circuit breaker of circuit breaker system 3000.

Figure 4:
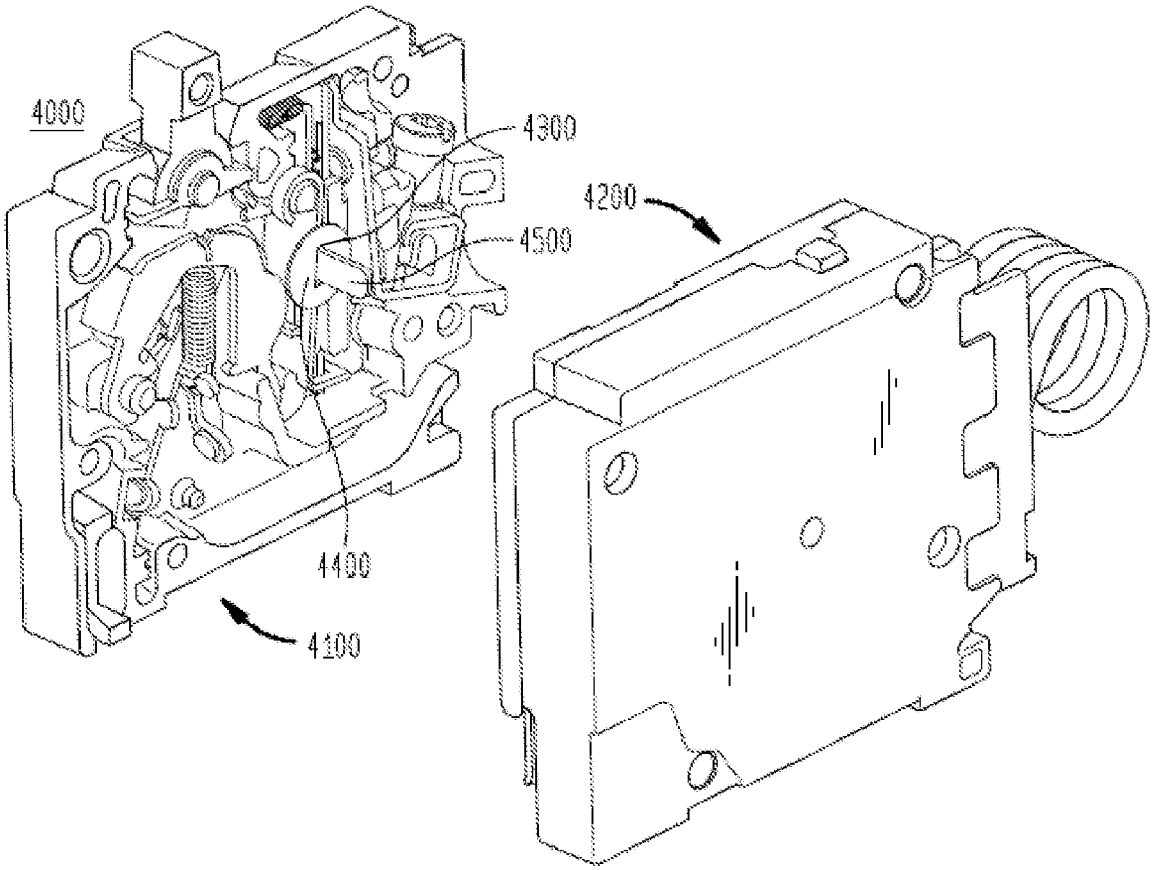
FIG. 4 illustrates an exploded perspective view of an exemplary embodiment of a circuit breaker system, 4000 including a thermoelectric portion and a data processing and a wafer received over a protrusion.

FIG. 4 is a perspective view of an exemplary embodiment of a circuit breaker system. 4000, which can comprise a thermoelectric portion 4100, a data processing portion 4200, a wafer 4300, and a protrusion 4400. Wafer 4300 can define an opening 4400, which can be adapted to receive protrusion 4500. Wafer 4300 can be adapted to be operatively installed between thermoelectric portion 4100 and data processing portion 4200. When installed, wafer 4300 can be adapted to:

- receive protrusion 4500 of thermoelectric portion 4100 through opening 4400. In certain exemplary embodiments, protrusion 450 can be a moving and/or rotatable protusion;
- seat in a recess defined in at least one of thermoelectric portion 4100 and data processing portion 4200;
- resist a passage of gas and debris from thermoelectric portion 4100 to data processing portion 4200 following a short circuit event; and/or
- substantially not impede motion of protrusion 4500 of thermoelectric portion 4100.

Wafer 4300 can be adapted to resist a migration of gases and/or debris from mechanical portion 4100 when an arcing condition occurs in mechanical portion 4100. Wafer 4300 can be adapted to reduce a size of an open path between mechanical portion 4100 and electronic portion 4200 in order to reduce a probability of damage to components of electronic portion 4200 during the arcing condition.

Figure 5:
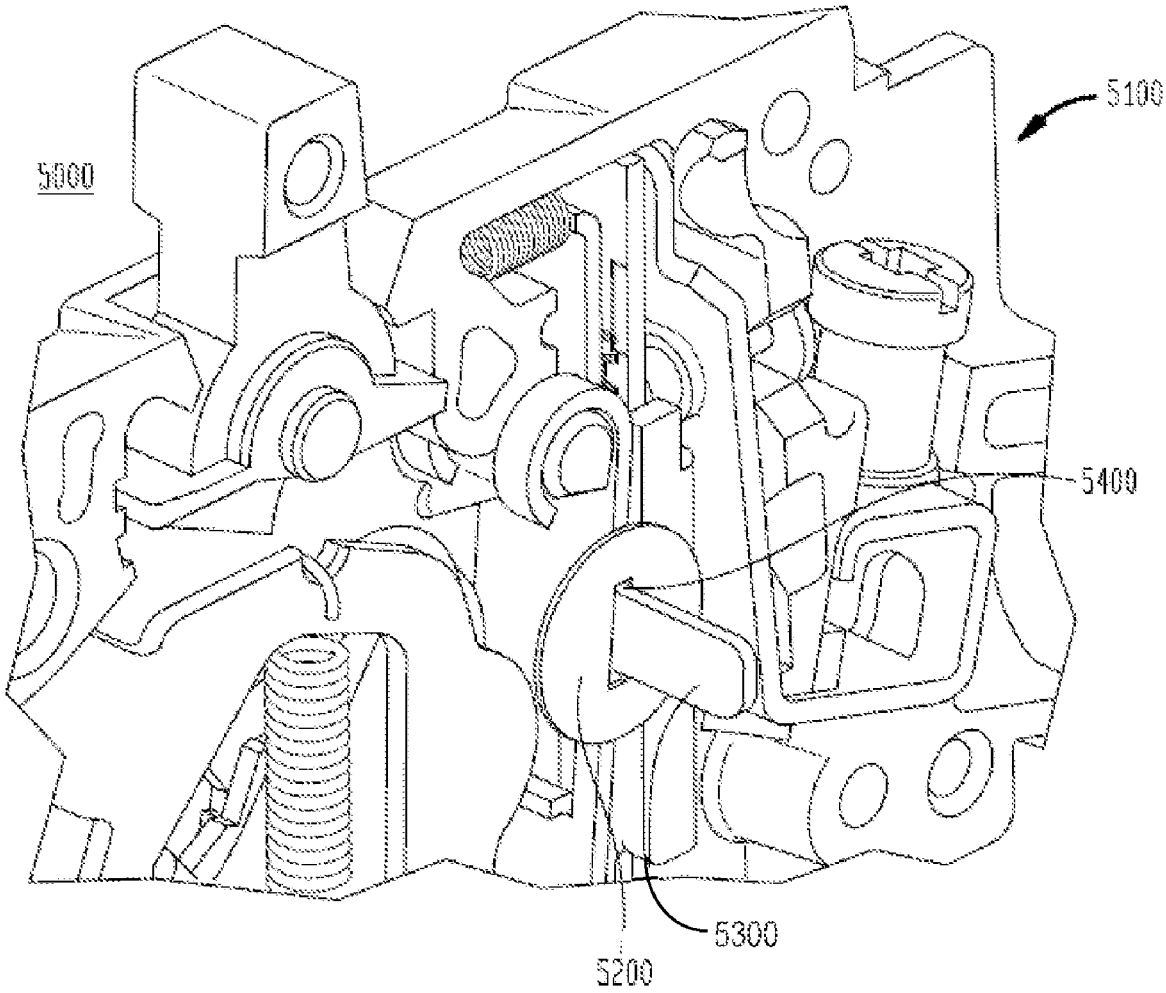
FIG. 5 illustrates a partial perspective view of a mechanical portion of an exemplary embodiment of a circuit breaker system, 5000 including a wafer with an opening received over an armature tab.

FIG. 5 is a perspective view of an exemplary embodiment of a circuit breaker system, 5000, which can comprise a mechanical portion 5100, a wafer 5200, and an armature tab 5300. Wafer 5200 can define an opening 5400 which can be adapted to receive armature tab 5200. In certain exemplary embodiments, wafer 5200 can be adapted to closely, forceably, substantially non-forceably, slideably, frictionally, substantially non-frictionally, releasably, substantially non-destructively, and/or substantially non-destructively releasably receive armature tab 5200. Wafer 520 can be adapted to be operatively installed between mechanical portion 5100 and a corresponding electronic portion of circuit breaker system 5000. When installed, wafer 520 can be adapted to:

- through opening 5400, receive armature tab 5300, which can be a moving armature portion of mechanical portion 5 100;
- block and/or resist a passage of gas and debris from mechanical portion 5100 to a corresponding electronic portion of circuit breaker system 5000 following a short circuit event; and or
- substantially not impede motion of armature tab 5300.

Figure 6:
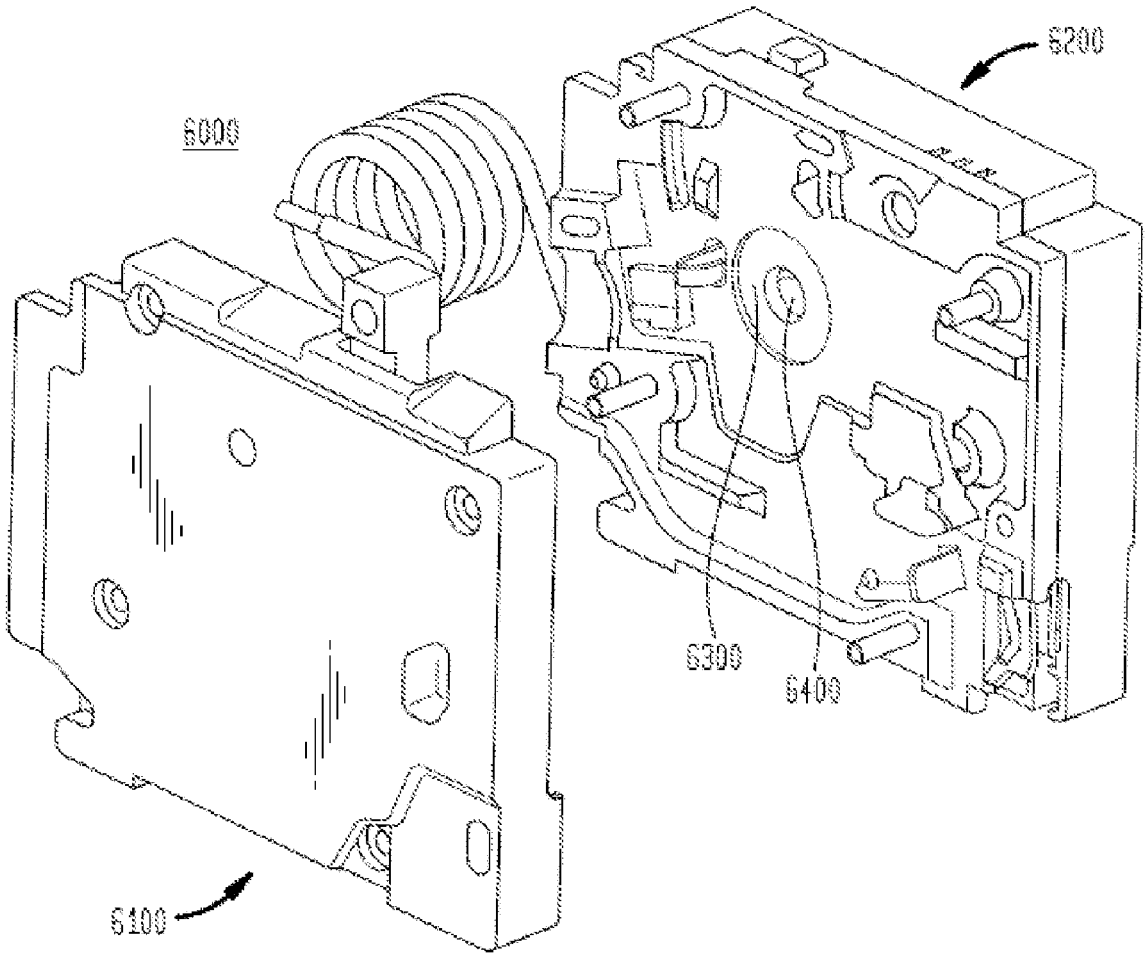
FIG. 6 illustrates an exploded perspective view of an exemplary embodiment of a circuit breaker system, 6000 including a mechanical portion and an electronic portion having a recess and passage therein.

FIG. 6 is a perspective view of an exemplary embodiment of a circuit breaker system, 6000, which can comprise a mechanical portion 6100 and an electronic portion 6200. Electronic portion 6200 can define a recess 6300, which can be adapted to partially surround a wafer. The wafer and/or recess 6300 can be substantially planar, circular, elliptical, and/or quadrilateral, etc. In certain exemplary embodiments, mechanical portion 6100 can define all or part of recess 6300. The wafer can be adapted to be seated in recess 63(0. The wafer can be adapted to reduce a size of a passage 6400 defined by electronic portion 6200 when mechanical portion 6100 and electronic portion 620 of system 6000 are operatively coupled.

Figure 7:
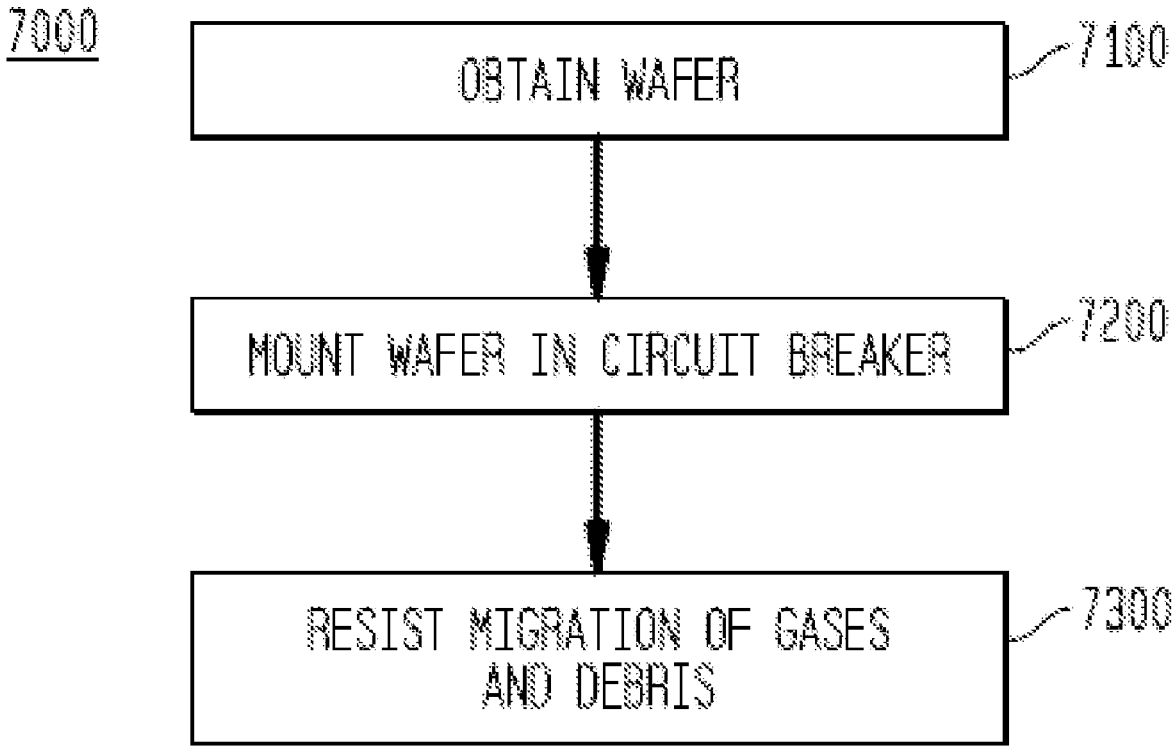
FIG. 7 illustrates a flowchart of an exemplary embodiment of a method 7000 of operating circuit breaker.

FIG. 7 is a flowchart of an exemplary embodiment of a method 700. At activity 710, a wafer can be obtained. The wafer can define an opening adapted to receive a protruding portion of a mechanical portion of a circuit breaker. The opening can be a slot. In certain exemplary embodiments, the wafer can define a substantially circular outer perimeter.

At activity 7200, the wafer can be operatively mounted and/or installed in the circuit breaker. The wafer can be operatively mounted and/or installed via operatively coupling the mechanical portion of the circuit breaker and the electronic portion of the circuit breaker. In certain exemplary embodiments, the wafer can be slideably coupled to a protrusion of the mechanical portion of the circuit breaker. The circuit breaker can be electrically coupled to an electrical load. The wafer can define an opening between the mechanical portion of a circuit breaker and the electronic portion of the circuit breaker. When installed, the wafer can be adapted to:

- through the opening, receive a moving protrusion, such as an armature tab and/or a portion of the armature, of the mechanical portion of the circuit breaker;
- seat in a recess defined in at least one of the mechanical portion of the circuit breaker and the electronic portion of the circuit breaker;
- resist a passage of gas and debris from the mechanical portion of the circuit breaker to the electronic portion of the circuit breaker following a short circuit event; and/or
- substantially not impede motion of the protrusion of the mechanical portion of the circuit breaker.

At activity 7300, the wafer can resist migration of gases and/or debris from the mechanical portion of the circuit breaker to the electronic portion of the circuit breaker, such as gasses and/or debris caused by an arcing condition. For example, the arcing condition can occur as a result of a short circuit event, which can be automatically detected (e.g., via the electronic portion). In certain exemplary embodiments, the short circuit event can cause the protrusion of the mechanical portion of the circuit breaker to move and/or the circuit breaker to trip.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

- a—at least one.
- activity—an action, act, step, and/or process or portion thereof.
- adapted to—suitable, fit, and/or capable of performing a specified function.
- and/or—either in conjunction with or in alternative to.
- apparatus—an appliance or device for a particular purpose.
- approximately—about and/or nearly the same as.
- armature—a part of an electromagnetic device that moves.
- associated with—related to.
- at least—not less than.
- automatically—acting and/or operating in a manner essentially independent of external human influence and/or control. For example, an automatic light switch can turn on upon "seeing" a person in its view, without the person manually operating the light switch.
- between—in a separating interval and/or intermediate to.
- can—is capable of, in at least some embodiments.
- cause—to bring about, provoke, precipitate, produce, elicit, be the reason for, result in, and/or effect.
- circuit—an electrically conductive pathway and/or a communications connection established across two or more switching devices comprised by a network and between corresponding end systems connected to, but not comprised by the network.
- circuit breaker—a re-settable device adapted to automatically open an alternating current electrical circuit to protect the circuit from damage caused by overload and/or short circuit.
- circular—a substantially round shape in which all points on a perimeter of the shape are substantially equidistant from a center of the shape.
- comprise—to include but not be limited to.
- configured to—capable of performing a particular function.
- coupling—(n) a device adapted to join, connect, and/or link; (v) joining, connecting, and/or linking.
- current—a flow of electrical energy.
- data—information represented in a form suitable for processing by an information device.
- data processing portion—a part of a circuit breaker comprising a microprocessor adapted to cause the circuit breaker to trip responsive to a determined arc fault condition.
- debris—a solid substance.
- define—to establish the meaning, relationship, outline, form, and/or structure of; and/or to precisely and/or distinctly describe and/or specify.
- detect—to sense, perceive, identify, discover, ascertain, respond to, and/or receive the existence, presence, and/or fact of.
- determination—an act of making or arriving at a decision.
- device—an instrumentality adapted to a particular purpose.
- digital—non-analog; discrete.
- electrical—relating to producing, distributing, and/or operating by electricity.
- electrically—of, relating to, producing, or operated by electricity.
- electrically couple—connected in a manner adapted to allow a flow of electricity therebetween.
- electronic portion—a part of a circuit breaker comprising a microprocessor adapted to cause the circuit breaker to trip responsive to a determined arc fault condition.
- energy—usable power.
- event—an occurrence.
- following—coming after in time.
- from—used to indicate a source.
- further—in addition.
- gas—matter that comprises a collection of substances (e.g., molecules, atoms, ions, and/or electrons, etc.) without a definite shape or volume that is in more or less random motion.
- generate—to create, produce, render, give rise to, and/or bring into existence.
- impede—to resist, retard, obstruct, hinder, and/or at least partially block.
- input—a signal, data, and/or information provided to a processor, device, and/or system.
- install—to connect or set in position and prepare for use.
- load—an energy sink.
- manage—to exert control or influence over, direct, and/or control the use, affairs, and/or interests of.
- may—is allowed and/or permitted to, in at least some embodiments.

measure—(n) a quantity ascertained by comparison with a standard; (v) to physically sense, and/or determine a value and/or quantity of something relative to a standard.

mechanical portion—a part of a circuit breaker comprising a pair of electrical contacts and a bimetal adapted to open the electrical contacts responsive to an over-temperature condition.

method—a process, procedure, and/or collection of related activities for accomplishing something.

microprocessor—a device adapted to perform one or more predetermined tasks, such as acting upon information by manipulating, analyzing, modifying, converting, transmitting the information for use by an executable procedure and/or an information device, and/or routing the information to an output device. A microprocessor can be a central processing unit, a local controller, a remote controller, parallel controller, and/or distributed controller, etc. The microprocessor can be a general-purpose microcontroller, such the Pentium IV series of microprocessor manufactured by the Intel Corporation of Santa Clara, Calif. In another embodiment, the microprocessor can be an Application Specific Integrated Circuit (ASIC) or a Field Programmable Gate Array (FPGA) that has been designed to implement in its hardware and/or firmware at least a part of an embodiment disclosed herein.

motion—movement due to rotation and or translation.

move—to change a position and/or place.

obtain—to receive, get, take possession of, procure, acquire, calculate, determine, and/or compute.

occur—to take place.

opening—an aperture.

operative—being in effect; operating.

outer—farther than another from the center and/or middle.

output—something produced, and/or generated.

not—a negation of something.

passage—transfer, conveyance, and/or transmission.

perimeter—the outer limits or boundary of an object.

plurality—the state of being plural and/or more than one.

portion—a part, component, section, percentage, ratio, and/or quantity that is less than a larger whole. Can be visually, physically, and/or virtually distinguishable and/or non-distinguishable.

predetermined—established in advance.

prevent—to impede, hinder, stop, and/or keep from happening.

protrusion—a component that projects from a portion of a circuit breaker.

provide—to furnish, supply, give, convey, send, and/or make available.

receive—to gather, take, acquire, obtain, accept, get, and/or have bestowed upon.

recess—a receded space defined by an object.

relative—considered with reference to and/or in comparison to something else.

replace—to provide a substitute and/or equivalent in the place of.

request—(n) that which communicates an expression of desire and/or that which is asked for; (v) to express a need and/or desire for; to inquire and/or ask for.

resist—to avoid, act, and/or remain firm against and or in opposition to the actions, effects, and/or force of.

responsive—reacting to an influence and/or impetus.

said—when used in a system or device claim, an article indicating a subsequent claim term that has been previously introduced.

seat—to place in a predetermined location.

sensor—a device adapted to automatically sense, perceive, detect, and/or measure a physical property (e.g., pressure, temperature, flow, mass, heat, light, sound, humidity, proximity, position, velocity, vibration, loudness, voltage, current, capacitance, resistance, inductance, and/or electro-magnetic radiation, etc.) and convert that physical quantity into a signal. Examples include proximity switches, stain gages, photo sensors, thermocouples, level indicating devices, speed sensors, accelerometers, electrical voltage indicators, electrical current indicators, on/off indicators, and/or flowmeters, etc.

short circuit—an unintentional connection of low resistance and/or impedance in a circuit such that excessive and/or damaging current flows through the unintentional connection.

signal—information encoded as automatically detectable variations in a physical variable, such as a pneumatic, hydraulic, acoustic, fluidic, mechanical, electrical, magnetic, optical, chemical, and/or biological variable, such as power, energy, pressure, flowrate, viscosity, density, torque, impact, force, frequency, phase, voltage, current, resistance, magnetomotive force, magnetic field intensity, magnetic field flux, magnetic flux density, reluctance, permeability, index of refraction, optical wavelength, polarization, reflectance, transmittance, phase shift, concentration, and/or temperature, etc. Depending on the context, a signal can be synchronous, asynchronous, hard real-time, soft real-time, non-real time, continuously generated, continuously varying, analog, discretely generated, discretely varying, quantized, digital, continuously measured, and/or discretely measured, etc.

single—existing alone or consisting of one entity.

slideably—a smooth and/or continuous motion of one object relative to another.

slot—an opening having a longer length than a width of the opening.

substantially—to a considerable, large, and/or great, but not necessarily whole and/or entire, extent and/or degree.

system—a collection of mechanisms, devices, machines, articles of manufacture, processes, data, and/or instructions, the collection designed to perform one or more specific functions.

tab—a protruding portion.

temperature—a measure of the average kinetic energy of the molecules in a sample of matter, expressed in terms of units or degrees designated on a standard scale.

thermoelectric portion—a part of a circuit breaker comprising a pair of electrical contacts and a bimetal adapted to open the electrical contacts responsive to an over-temperature condition.

through—in one side and out the opposite or another side of, across, among, and/or between.

trip—(n) an opening of an electrical circuit that interrupts current flow in the electrical circuit; (v) to open an electrical circuit and/or to automatically interrupt current flow in an electrical circuit.

user—a person, organization, process, device program, protocol, and/or system that uses a device, system, process, and/or service.

voltage—(a.k.a., "potential difference" and "electro-motive force" (EMF)) a difference in electrical potential between any two conductors of an electrical circuit and/or a quantity, expressed as a signed number of Volts (V), and measured as a signed difference between two points in an electrical circuit which, when divided by the resistance in Ohms between those points, gives the current flowing between those points in Amperes, according to Ohm's Law.

value—a measured, assigned, determined, and/or calculated quantity or quality for a variable and/or parameter.

via—by way of and/or utilizing.

wafer—a piece of material defining an opening that is substantially similar in size to a protrusion of a circuit breaker, the piece of material adapted to move with the protrusion.

when—at a time.

wherein—in regard to which; and; and/or in addition to.

NOTE

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, of any particular interrelationship of elements.

any elements can be integrated, segregated, and/or duplicated.

any activity can be repeated, any activity can be performed by multiple entities, and or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope.

Any information in any material (e.g., a United States patent, United States patent application, book, article. etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, su nary, description, abstract, drawing figure. etc.) of this application, other than the claims themselves, is to be regarded as illustrative in nature, and not as restrictive.

What is claimed is:

1. A circuit breaker comprising:

a mechanical portion of a circuit breaker having a protruding armature tab;

an electronic portion of the circuit breaker having a passage receiving the protruding armature tab; and a substantially planar wafer having a slot opening, the slot opening of the substantially planar wafer received over the protruding armature tab, the wafer being received between the mechanical portion and the electronic portion and seated in a substantially planar recess defined in at least one of the mechanical portion and the electronic portion.

2. A system comprising:

a wafer having an opening, said wafer operatively installed between a mechanical portion of a circuit breaker and an electronic portion of said circuit breaker, said wafer receiving a moving armature tab of said mechanical portion of said circuit breaker through said opening in the wafer;

wherein the wafer is operable to resist a passage of gas and debris from said mechanical portion of said circuit breaker to said electronic portion of said circuit breaker following a short circuit event and substantially not impede motion of said moving armature tab.

3. The system of claim 2, further comprising:

said electronic portion of said circuit breaker including a recess into which the wafer is seated.

4. The system of claim 2, further comprising:

said moving armature tab of said circuit breaker being received through a slot comprising the opening in the wafer.

5. The system of claim 2, wherein:

said wafer is seated in a recess defined in at least one of said mechanical portion of said circuit breaker and said electronic portion of said circuit breaker.

6. A system comprising:

a thermoelectric portion of a circuit breaker;

a data processing portion of said circuit breaker; and a wafer having an opening, said wafer operatively installed between said thermoelectric portion of said circuit breaker and said data processing portion of said circuit breaker, wherein said wafer receives a moving protrusion of said thermoelectric portion of said circuit breaker through said opening in said wafer;

seats in a recess defined in at least one of said thermoelectric portion of said circuit breaker and said data processing portion of said circuit breaker;

is operable to resist a passage of gas and debris from said thermoelectric portion of said circuit breaker to said data processing portion of said circuit breaker following a short circuit event; and is operable to substantially not impede motion of said protrusion of said thermoelectric portion of said circuit breaker.

7. A method comprising:

providing a wafer having an opening;

installing the wafer between a mechanical portion of a circuit breaker and an electronic portion of said circuit breaker;

receiving a moving protrusion of said mechanical portion of said circuit breaker through said opening of the wafer;

seating the wafer in a recess defined in at least one of said mechanical portion of said circuit breaker and said electronic portion of said circuit breaker;

resisting a passage of gas and debris from said mechanical portion of said circuit breaker to said electronic portion of said circuit breaker following a short circuit event; and substantially not impeding motion of said protrusion of said mechanical portion of said circuit breaker.

8. The method of claim 7, further comprising:

operatively coupling said mechanical portion of said circuit breaker and said electronic portion of said circuit breaker.

9. The method of claim 7, further comprising:

electrically coupling said circuit breaker to an electrical load.

10. The method of claim 7, further comprising:

automatically detecting said short circuit event.

11. The method of claim 7, further comprising:

slideably coupling said wafer to said protrusion of said mechanical portion of said circuit breaker by sliding a slot comprising the opening over said protrusion.

12. The method of claim 7, further comprising:

responsive to a determination that said short circuit has occurred, replacing said wafer.

13. The method of claim 7, further comprising:

responsive to a determination that said short circuit has occurred, causing said wafer to be replaced.

14. The method of claim 7, wherein:

said protrusion of said mechanical portion of said circuit breaker is an armature tab.

15. The method of claim 7, wherein:

said short circuit event causes said protrusion of said mechanical portion of said circuit breaker to move.

16. The method of claim 7, wherein:

said short circuit event causes said circuit breaker to trip.

17. The method of claim 7, wherein:

said opening is a slot.

18. The method of claim 7, wherein:

said wafer has a substantially circular outer perimeter.

* * * * *